US007893379B2

(12) United States Patent
Schoenemann et al.

(10) Patent No.: US 7,893,379 B2
(45) Date of Patent: Feb. 22, 2011

(54) GENERATOR CIRCUIT BREAKER WITH IMPROVED SWITCHING CAPACITY

(75) Inventors: Thomas Schoenemann, Schafisheim (CH); Jochen Kiefer, Nussbaumen (CH); Patrick Huguenot, Zurich (CH); Max Claessens, Gebenstorf (CH); Stephan Grob, Baden (CH); Xiangyang Ye, Kunten (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/812,575

(22) Filed: Jun. 20, 2007

(65) Prior Publication Data

US 2008/0006609 A1 Jan. 10, 2008

Related U.S. Application Data

(63) Continuation of application No. PCT/CH2004/000752, filed on Dec. 24, 2004.

(51) Int. Cl.
*H01H 33/91* (2006.01)

(52) U.S. Cl. ..... 218/157; 218/46; 218/156

(58) Field of Classification Search ..... 218/12–15, 218/34, 35, 43–46, 51–56, 59–69, 76, 156–158
See application file for complete search history.

(56) References Cited

U.S. PATENT DOCUMENTS

| | | | | |
|---|---|---|---|---|
| 4,254,314 | A | 3/1981 | Kummerow et al. | |
| 4,471,187 | A * | 9/1984 | Sturzenegger et al. | 218/51 |
| 4,650,941 | A | 3/1987 | Thuries et al. | |
| 6,872,907 | B2 * | 3/2005 | Claessens et al. | 218/66 |
| 7,022,922 | B2 * | 4/2006 | Nowakowski | 200/12 |
| 7,202,435 | B2 | 4/2007 | Claessens et al. | |
| 2004/0057167 | A1 * | 3/2004 | Claessens et al. | 361/2 |
| 2005/0173378 | A1 * | 8/2005 | Nowakowski | 218/43 |
| 2007/0068904 | A1 * | 3/2007 | Dahlquist et al. | 218/59 |

FOREIGN PATENT DOCUMENTS

| | | |
|---|---|---|
| DE | 1 889 068 | 3/1964 |
| DE | 1933529 | 1/1971 |

(Continued)

OTHER PUBLICATIONS

*Translation of PCT/IB/338 for PCT/CH2004/000752 dated Dec. 21, 2007.

(Continued)

*Primary Examiner*—Renee Luebke
*Assistant Examiner*—Marina Fishman
(74) *Attorney, Agent, or Firm*—Buchanan Ingersoll & Rooney PC

(57) ABSTRACT

The disclosure relates to an electrical switching device, e.g., a generator circuit breaker, and to a method for improved switching-gas cooling. Gas jets are formed by a nozzle body in the exhaust area, are directed against a baffle wall and are swirled. The baffle wall is a component of the switching chamber enclosure and has a high thermal capacity and/or thermal conductivity, so that the switching gas vortices produce a highly efficient switching gas cooling on the baffle wall by turbulent convection. Exemplary embodiments relate inter alia to the design of the baffle wall and of the nozzle body. Advantages include: protection of the switching chamber enclosure against hot gases, improved switching gas cooling, and increased breaking capacity.

20 Claims, 4 Drawing Sheets

FOREIGN PATENT DOCUMENTS

| | | | |
|---|---|---|---|
| DE | 1765431 | | 7/1971 |
| DE | 25 07 163 | A1 | 10/1975 |
| DE | 198 50 395 | A1 | 5/2000 |
| DE | 101 56 535 | C1 | 6/2003 |
| DE | 102 21 580 | B3 | 1/2004 |
| EP | 0 720 774 | B1 | 7/1996 |
| EP | 1 403 891 | A1 | 3/2004 |
| GB | 1594487 | | 7/1981 |
| JP | 58-71524 | | 4/1983 |
| JP | 2002-298709 | | 10/2002 |
| WO | WO 03046939 | | 6/2003 |

OTHER PUBLICATIONS

PCT/ISA/210 for PCT/CH2004/000752 dated Sep. 26, 2005.

* cited by examiner

GENERATOR CIRCUIT BREAKER WITH IMPROVED SWITCHING CAPACITY

RELATED APPLICATIONS

This application is a continuation application under 35 U.S.C. §120 to PCT/CH2004/000752 filed as an International Application on Dec. 24, 2004, designating the U.S., the entire contents of which are hereby incorporated by reference in their entireties.

TECHNICAL FIELD

The disclosure relates to the field of high-voltage technology, e.g., high-current circuit breaker technology in electrical power distribution systems. It is based on a method and generator circuit breaker.

BACKGROUND INFORMATION

The disclosure is based on the prior art according to EP 1 403 891 A1, which discloses a circuit breaker in which exhaust gas from an arcing area is passed through a hollow contact into a concentrically arranged exhaust volume, and from there into a quenching chamber volume located further outward. In order to increase the disconnection rating, at least one intermediate volume and, possibly, an additional volume is or are arranged concentrically between the hollow contact and the exhaust volume, separated from one another by intermediate walls which have holes or openings through which gas can pass. The exhaust gases are swirled by the switching gases flowing out radially from the inner and to the outer volumes, and a large amount of thermal energy can be transferred to the intermediate walls of the volumes. The aperture openings between the hollow-contact volume, the intermediate volume and, if appropriate, the additional volume are arranged offset with respect to one another on the circumference. The aperture openings between the additional volume and the exhaust volume are arranged offset with respect to one another on the circumference and/or in the axial direction. This results in meandering as well as spiral exhaust-gas paths being predetermined, with the dwell time for which the exhaust gas remains in the exhaust area being increased, and with the heat transfer from the exhaust gas being improved. Furthermore, the holes can be closed by means of panels in the form of perforated metal sheets, in order to produce a multiplicity of radially directed gas streams or gas jets, which strike the opposite wall, are swirled at the impact points, and thus intensively cool the hot gas. The intermediate volume, which improves the cooling, is arranged in the exhaust area on the drive contact side. A second intermediate volume may also be provided on the fixed-contact side. Overall at least one further intermediate volume is also required in the circuit breaker, that is to say in addition to the hollow-contact volume, the exhaust volume and the switching chamber volume, in order to achieve efficient exhaust-gas cooling.

DE 25 07 163 A1 discloses an electrical switch which has linings which are arranged on the inside of the switching chamber enclosure and are composed of highly thermally conductive metal. The linings are used as coolers, temperature distributors, field distribution rings, shields for protection of the insulating surfaces against corrosion and diffusion, and as an element for deflection of the switching gas flow. In this case, the switching gas flow is guided in a laminar fashion along the linings. No baffle wall for vortex formation is provided in the switching gas flow.

DE 101 56 535 C1 discloses an electrical switch which has a flow guidance device, by means of which partial gas streams are guided towards one another, with vortices being formed in consequence. The crossing-over of the partial gas streams and their swirling and vortex formation replaces a heat-absorbing baffle wall. For additional vortex formation, the flow guidance device may have small vortex-formation bodies arranged adjacent to outlet openings and influencing the guidance of the quenching gas. These vortex-formation bodies are not used to extract heat from the switching gas.

In utility model DE 1 889 068 U a switch disconnector with improved exhaust-gas cooling is disclosed. The cooling apparatus has a plurality of tubes which are arranged concentrically in the gas outlet channel and each have diametrically opposite outlet openings, so that the switching gases pass through a labyrinthine path with numerous deflections while flowing out in a laminar form, and have to cover large surface areas of the cooling tubes. This arrangement therefore substantially lengthens the outlet-flow path, and enlarges the cooling surface area in the exhaust. The outlet openings are chosen to be broad, in order to keep the switching gas backpressure low. The flow channels between the cooling tubes are chosen to be narrow, in order to provide a large cooling surface area for the switching gas. Overall, the flow is kept in the laminar range, and the switching gas is cooled by laminar convective heat transfer to the cooling tubes.

EP 0 720 774 B1 discloses a high-voltage circuit breaker having a hollow-cylindrical metal wire mesh or metal body as a heat sink for switching gases. In addition, a dielectric body is provided, is located further inward, does not allow quenching gas to pass through, shields the metal body from the quenching gases, precools the quenching gases by material vaporization, and thus counteracts overheating of the metal wire mesh. As it flows through the metal wire mesh, the quenching gas is cooled further by interaction with the metal surface of this mesh. Owing to the large number of aperture openings, the flow resistance of the metal wire mesh is low, again resulting in laminar flow.

DE 102 21 580 B3 discloses a high-voltage circuit breaker having an interrupter unit, in which the exhaust gases are deflected twice through 180°. In order to improve the cooling of the gases, a concentrically arranged, hollow-cylindrical perforated metal sheet through which flow passes radially is provided on the fixed-contact side. The perforated metal sheet is again used as a heat sink, which extracts heat from the quenching gas without increasing the flow resistance for the quenching gas and without disturbing the laminar quenching-gas flow.

SUMMARY

An electrical circuit breaker device can be capable of an improved rating or switching capability. A method is disclosed for cooling a switching gas in an electrical switching device for electrical power supply systems, in particular in a generator circuit breaker, with the switching device having a switching chamber which is surrounded by a switching chamber enclosure, wherein further during a switching process the switching gas flows from an arc quenching zone to an exhaust area, thereby passes through a body which has a multiplicity of outlet openings, and is split into a plurality of directed gas jets, wherein further the gas jets are swirled into a plurality of vortices and thermal energy is extracted from the vortices by a baffle wall through convection in the area of the baffle wall, wherein further the baffle wall is formed by at least one section of the switching chamber enclosure, or is attached to a section of the switching chamber enclosure. The body through which the flow passes therefore builds up a sufficiently large backpressure in the switching gas such that bundled gas jets can be produced from the outlet openings of the body. The body through which flow passes is used primarily for jet formation and itself needs not to have any cooling effect on the switching gas. The improved exhaust-gas cooling is achieved by removal of the thermal energy via turbulent heat transfer from the vortices to the baffle wall and by allowing highly efficient heat dissipation from the baffle wall, as a component of the switching chamber enclosure, or as a part fitted to the switching chamber enclosure. The thermal energy can be stored in the baffle wall, or can be passed to a heat sink which is thermally connected to the baffle wall. Furthermore, a jet characteristic of the outlet openings is matched to the distance to the baffle wall such that the vortices are formed adjacent to or in the area of the baffle wall.

An exemplary embodiment can have the advantage that no electrical flashovers between the switching gas and the baffle wall are expected, because there is no or no significant potential gradient in the outer volume through which the switching gas flows. Even still highly ionized switching gas, which has not yet dielectrically recovered, can be cooled on the baffle wall, which is on a live potential.

Another exemplary embodiment can have the advantage that the switching chamber enclosure is used in its entirety or at least on a circuit breaker-contact side as a large-volume heat sink for the thermal energy absorbed by the baffle wall.

In a further exemplary embodiment, the formation of the vortices is supported by interaction of the gas jets with one another before reaching the baffle wall. In particular, gas jets shall be formed in the body such that their trajectories cross one another before reaching the baffle wall. This means that the vortices are not just formed by the impact of separate gas jets on the baffle wall, but are actually induced already on their way to the baffle wall by interaction among the gas jets. In the extreme, the interactive vortex formation is so strong that there is no longer any actual impact point of individual gas jets on the baffle wall, but a vortex, which is formed from at least two gas jets, arrives directly and is cooled down by turbulent convection at the baffle wall.

The disclosure also relates to an electrical switching device for an electrical power supply system, in particular a generator circuit breaker, comprising a switching chamber which is surrounded by a switching chamber enclosure and has a central axis and a first contact and a second contact, with a body with outlet openings for switching gas to flow through being provided in a exhaust area of the first or second contact, with the exhaust area being subdivided by the body into an inner volume and an outer volume, and with a baffle wall for cooling of the switching gas being provided in the outer volume, wherein further the outlet openings of the body are used to produce a plurality of directed gas jets, the gas jets are directed towards the baffle wall and a plurality of vortices are formed and the vortices produce a convective heat transfer from the switching gas to the baffle wall, wherein the baffle wall is formed by at least one section of the switching chamber enclosure, or is attached to a section of the switching chamber enclosure. In addition, the outlet openings of the body are nozzles which predetermine a desired jet characteristic and/or alignment for the gas jets by virtue of their arrangement, shape and/or alignment, wherein the gas jets are subject to collimation, widening or focusing in the nozzles, which collimation, widening or focusing is matched to the distance to the baffle wall such that the vortex formation takes place adjacent to the baffle wall or in an area of the baffle wall. Furthermore, the baffle wall has a large thermal capacity for cooling the turbulent switching gas, and/or the baffle wall has a high thermal conductivity for cooling the turbulent switching gas and is thermally conductively connected to the switching chamber enclosure.

The body or multi-nozzle body is therefore also used to split the switching gas into a plurality of directed gas jets in at least one exhaust area of the switching device, and the baffle wall is used for jet swirling and/or for the swirled jets to flow along, in order to extract thermal energy from the switching gas or the switching-gas vortices, respectively, by turbulent, convective heat transfer. The baffle wall may itself be a heat sink, or may be thermally connected to a heat sink. In particular, the baffle wall may be designed to have a very large area by virtue of its position close to the switching chamber wall or as a component of the switching chamber enclosure, and can be used for turbulent cooling of a large number of gas-jet-induced switching-gas vortices. An exemplary switching device cab be found to have excellent disconnection ratings because of the improved cooling of the switching gases.

Accordingly, the functions of the body as a multi-nozzle body, and the baffle wall as heat dissipation, are separate. The body can thus be optimized in terms of its arrangement in the exhaust area and of the design and arrangement of its nozzles, and the baffle wall can be optimized independently of this with respect to its arrangement in the outer volume, its thermal characteristics and its thermal connection to the switching chamber enclosure. Owing to the large thermal mass and/or high thermal conductivity of the baffle wall or of the switching chamber enclosure section, local heating at the points where the gas jets impact is swiftly distributed over the entire baffle wall and, if necessary, is dissipated from the baffle wall.

Furthermore, the power range from which the turbulent convectional cooling comes into action can be defined more precisely and in particular can be widened by the optimized arrangement, in particular the separation, shape and/or alignment, of the nozzles. In particular, the emission characteristic of the nozzles of the body can be designed as a function of the position and, possibly, shape of the baffle wall so as to achieve intensive vortex formation and good guidance of the vortices close to the baffle wall and along large areas of the baffle wall.

Yet, other exemplary embodiments can have the advantage that even very heavily ionized, hot switching gas can be cooled by the baffle wall. The double function of the baffle wall as a heat sink and current path allows for a particularly simple and compac design of the switching device.

Yet, another exemplary embodiment can have the advantage that the crossing gas jets reinforce the vortex formation process. Furthermore, vortex formation can be achieved even earlier, that is to say in a lower power range.

Other exemplary embodiments as disclosed can relate to further measures for improving the cooling efficiency of the switching gas in the switching device and thus for increasing the switching rating.

BRIEF DESCRIPTION OF THE DRAWINGS

Further exemplary embodiments, advantages and applications are discussed in the description which now follows, and the figures, in which.

Identical parts are provided with the same reference symbols in the figures.

DETAILED DESCRIPTION

Figure 1:
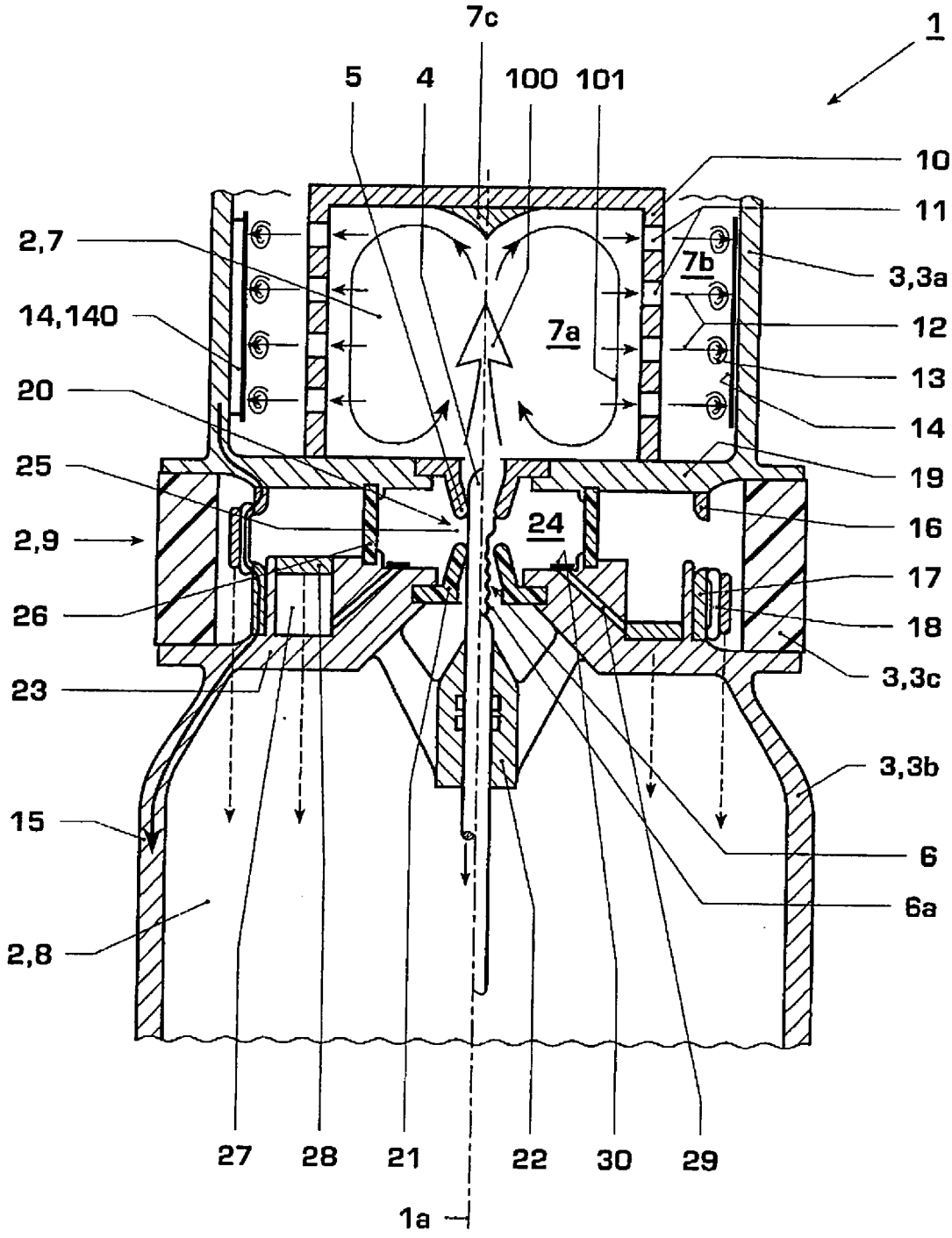
FIG. 1 shows an exemplary generator circuit breaker with a metal sleeve and an enclosure-side baffle wall for switching-gas cooling.

FIG. 1 shows a generator circuit breaker 1 with a circuit breaker axis 1*a* and a switching chamber 2 or interrupter unit 2, which comprises a quenching chamber 9 and exhaust volumes 7, 8. The switching chamber 2 is surrounded by a switching chamber enclosure 3. The switching chamber enclosure 3 is composed of a quenching chamber enclosure or quenching chamber isolator 3*c* and a first exhaust enclosure 3*a* and a second exhaust enclosure 3*b*. A first contact or contact pin 4 and a second contact in the form of a contact tulip 5, between which an arc 6*a* is struck on opening of the circuit breaker 1, are provided for the power current path and for arc interruption. The basic operation of the switching device 1 is described in EP 0 982 748 B1, whose entire disclosure content is hereby included by reference in the description. In particular, the functions of the switching device 1 are described there. The reference symbols denote the following components: rated current path 15, first stationary rated-current contact 16, second stationary rated-current contact 17, moving rated-current contact 18, first barrier wall 19, arcing contact arrangement 20, dielectric nozzle 21, sliding guide 22, second barrier wall 23, heating volume 24, blowing slot 25, wall 26, blowing cylinder 27, blowing piston 28, blowing channel 29, non-return valve 30. The functions and interaction of the components mentioned are described in more detail in EP 0 982 748 B1.

During opening of the arc switching contact pin 4, the arc quenching zone 6 is blown with quenching gas or switching gas from the heating volume 24. The switching gas then flows into the first and second exhaust areas 7, 8, where it is cooled. According to the disclosure, a body 10 with outlet openings 11 for switching gas to flow through is now arranged, for example, in the first exhaust area 7. The body 10 through which gas flows subdivides the exhaust area 7 into an inner volume 7*a* and an outer volume 7*b*. A baffle wall 14, 140 is provided in the outer volume 7*b*, in order to cool the switching gas. The baffle wall 14, 140 is formed by at least one section 14 of the switching chamber enclosure 3, or is attached as a plate 140, which may be formed more or less separately, to a section of the switching chamber enclosure 3. Highly efficient turbulent switching-gas cooling is achieved in this arrangement. A further advantage is that the switching chamber enclosure 3 is not directly contaminated by very hot switching gas, but is somewhat protected by the nozzle body 10.

The interaction of the body through which gas flows or of the nozzle body 10 with the baffle wall 14, 140 will be explained in more detail in the following text with reference to FIG. 1. A hot switching-gas flow 100 flows from the arc quenching zone 6 into the first exhaust area 7, is deflected by the flow deflection element 7*c* in a radial direction, flows back along an inner wall of the body 10, which is illustrated in the form of a sleeve in this case, and thus forms a recirculation flow 101, by means of which a backpressure is built up in the inner volume 7*a*. The switching gas flows outward in the form of gas jets 12 into the outer volume 7*b* through the outlet openings 11 in the body 10. The gas jets 12 are directed at the baffle wall 14, 140, and form vortices 13. This is typically a result of the impact of the gas jet 12 on the baffle wall 14, 140, so that one vortex 13 is formed for each gas jet 12 or impact location.

Figure 3:
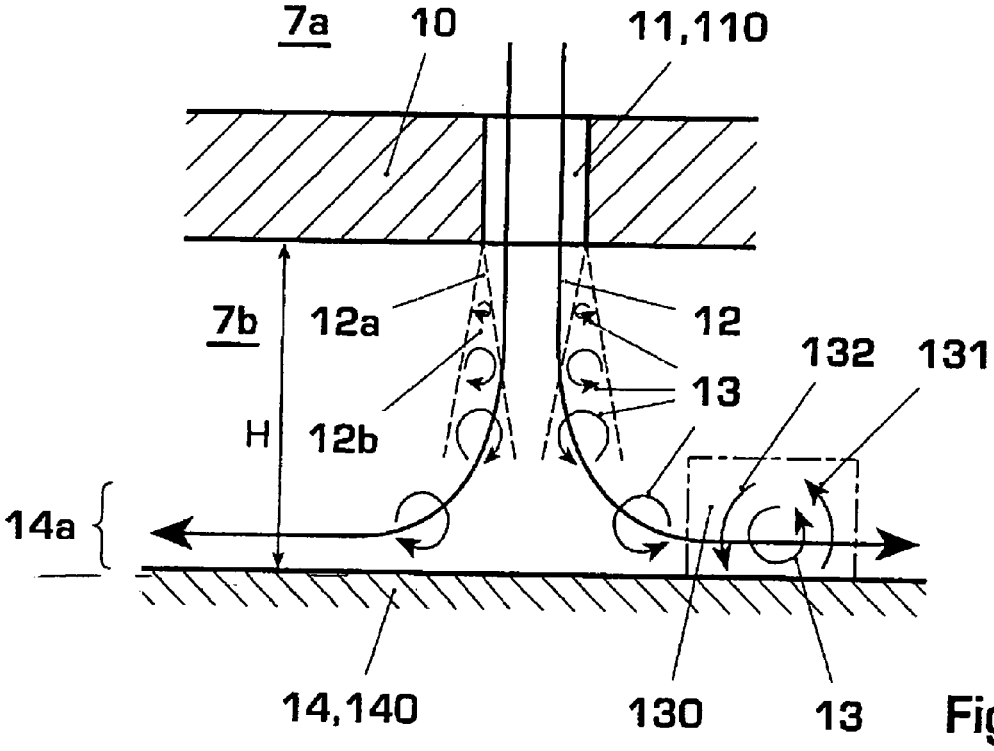
FIG. 3 is an illustration of an exemplary method of operation of the turbulent convective cooling.

FIG. 3 shows in greater detail how the vortices 13 create intensive cooling of the switching gas by turbulent convective heat transfer to the baffle wall 14, 140. The gas jet 12 is formed as the switching gas flows out of the opening 11. After leaving the outlet opening 11, the gas jet 12 forms a boundary layer 12*a*, 12*b*, with small vortices 13 being produced in a separation area 12*a*, whose strength and size increase as the distance from the nozzle body 10 increases, and which are deflected in an essentially axial direction as they approach the baffle wall 14, 140. A vortex area, vortex zone or vortex boundary layer 130 is formed in the vicinity of the baffle wall 14, 140, that is to say in the baffle wall area 14*a*, in which area, zone or layer the vortex 13 flows along the baffle wall 14, 140 depositing some of its thermal energy there, flowing away from the baffle wall 14, 140 in an outlet area 131 of the vortex 13, being recirculated and further sucking in switching gas in a wake area 132 and supplying it to the baffle wall 14, 140 for cooling. The switching gas is therefore intensively cooled by the repeated intensive gas exchange in the area of the baffle wall 14, 140. This is dependent on the baffle wall 14, 140 itself acting as an efficient heat sink. According to the disclosure, this is achieved by the baffle wall 14, 140 being formed by a section of the switching chamber enclosure 3, or being attached as a plate 140 or, in general, as a heat sink 140 to the switching chamber enclosure 3. For this purpose, the baffle wall 14, 140 may have a high thermal capacity for cooling of the turbulent switching gas. Alternatively or additionally, the baffle wall 14, 140 may have a high thermal conductivity for cooling of the turbulent switching gas, and may be thermally conductively connected to the switching chamber enclosure 3.

The baffle wall 14, 140 is advantageously at the same potential as the switching chamber enclosure 3, in order to reduce or to eliminate the risk of electrical flashovers. In consequence, the switching gas need not be precooled at this stage by interaction with the baffle wall 14, 140. In fact, it may still be hot and in particular ionized. A particularly compact arrangement is achieved by the baffle wall 14, 140 being part of a current path 15 of the switching device 1. In FIG. 1, the current path 15 is a rated-current path, but in principle may also be a power current path 15.

The nozzle body 10 may have a low thermal capacity and/or a low thermal conductivity. The nozzle body 10 therefore need not make any contribution to heat dissipation. However, an additional cooling effect and homogeneous heat distribution in the nozzle body 10 are advantageous. The outlet openings 11 of the body 10 should act as nozzles 110, 111, 112, which predetermine a desired jet characteristic and/or alignment for the gas jets 12 by virtue of their arrangement, shape and/or alignment. In particular, the gas jets 12 should be subject to collimation, widening or focusing in the nozzles 110, 111, 112, with this collimation, widening or focusing being matched to the distance H to the baffle wall 14, 140 such that vortices are formed adjacent to the baffle wall 14, 140 or in the area 14*a* of the baffle wall 14, 140.

Figure 2A:
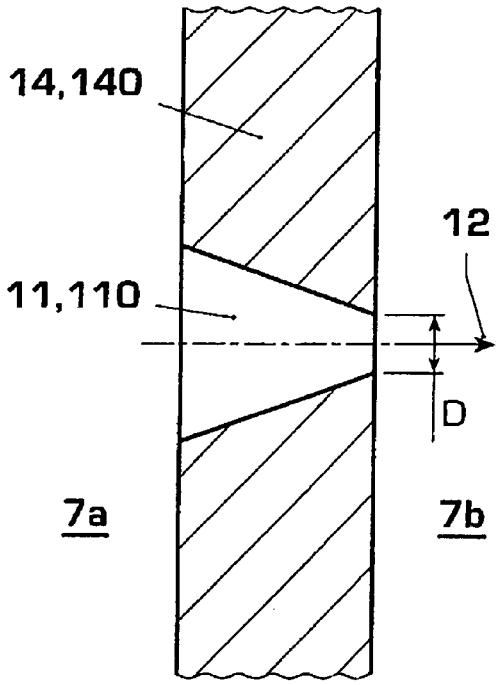
FIGS. 2*a*-2*d* show exemplary embodiments of the metal sleeve.
Figure 2B:
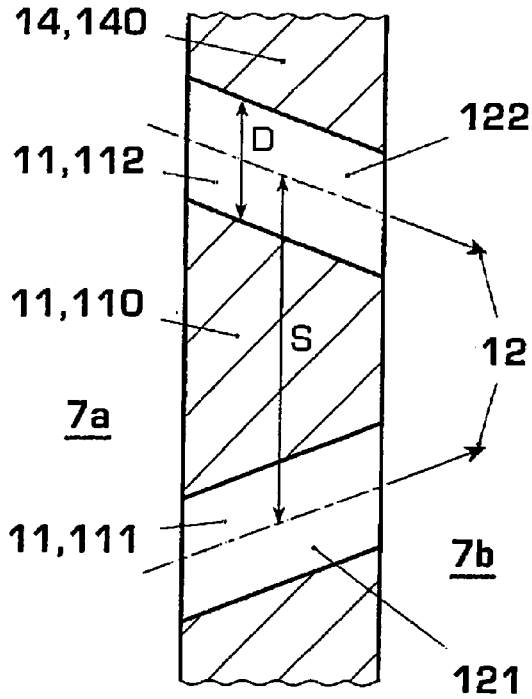

FIG. 2*a* shows an exemplary embodiment in which the nozzles 110 taper in the form of funnels in the flow direction, which is directed radially outwards, of the switching gas. As is shown in FIG. 2*b*, the nozzles 111, 112 which are provided are advantageously directed with respect to one another such that the trajectories 121, 122 of the associated gas jets 12 cross one another before reaching the baffle wall 14, 140, and form vortices before reaching the baffle wall 14, 140. The nozzles 111, 112 which are directed with respect to one another may in particular be mutually adjacent nozzles 111, 112 or else nozzle groups. The panel openings may also be cylindrical or may broaden conically in the jet direction, so that the gas jets 12 are widened. Further variants of the outlet openings 11 are described in EP 1 403 891 A1, whose entire disclosure content is hereby included by reference in the description. This document discloses, in particular: outlet openings offset axially and/or on the circumference relative to one another, outlet openings with different diameters, with different distances between centers, outlet openings optimized with respect to their shape, size, arrangement (for example predominantly in the upper part of the exhaust area) and number. For high cooling efficiency, a preferred range of $1.5<H/D<5$ and in particular $H/D=2$ is disclosed for the ratio of the distance H between the panel openings and the opposite wall to their diameter D. A ratio of $S/H=1.4$ is preferred for the ratio between the distance S between the centers of the panel openings to their diameter D. If this distance is not undershot, this ensures that the vortices which are formed around the impact points do not have a negative influence on one another, and the gas is effectively cooled.

The nozzle body 10 is advantageously a sleeve 10, in particular composed of metal. In principle the sleeve 10 may have any desired shape and, for example, is shaped to be hollow-cylindrical (FIG. 1) or tapered in the form of a truncated cone (FIG. 2*c*), or tapered conically (FIG. 2*d*). In FIG. 1, a lower cover is provided by the first barrier wall 19 between the quenching chamber 9 and the first exhaust area 7, and an upper cover is provided by a switching chamber wall. The sleeve 10 surrounds a volume V, with other openings or an incomplete sleeve shape in principle also being permissible in addition to the outlet openings 11, provided that sufficient backpressure can be built up and that jet formation is possible. The outlet openings 11 are advantageously the only openings. The ratio of the enclosed volume V to the total area A of the outlet openings 11 should advantageously be in the range $0.5\ m<V/A<1.5\ m$, preferably $1\ m<V/A<1.4\ m$, particularly preferably $1.2\ m<V/A<1.3\ m$.

Figure 2C:
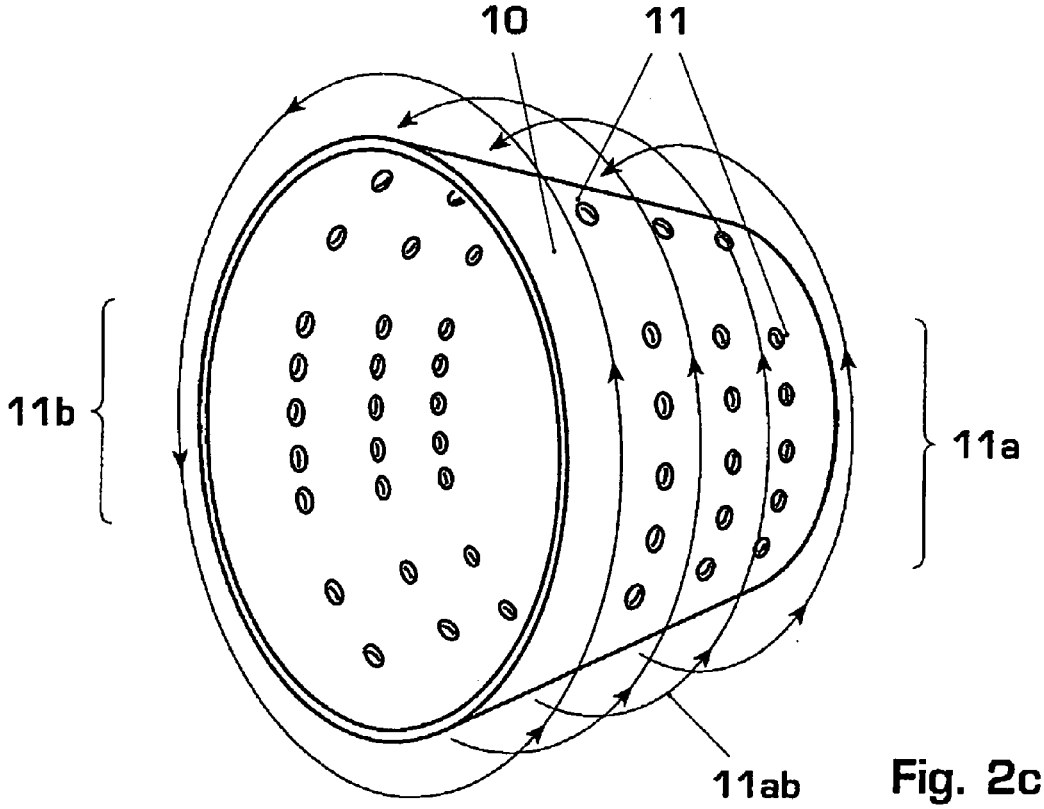
Figure 2D:
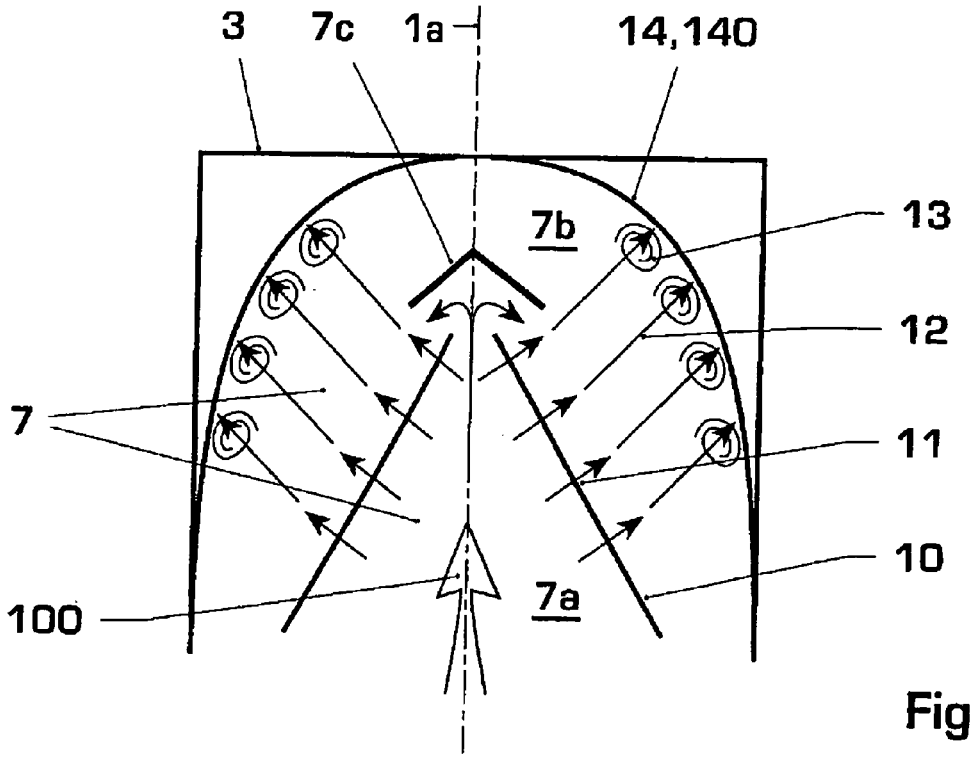

FIG. 2*c* shows an exemplary embodiment in which the outlet openings 11 are arranged more frequently in two radially opposite areas 11*a*, 11*b* on the body 10. A flow along the baffle wall 14, 140 can in this way be induced in the switching gas in the outer volume 7*b*. The guided flow typically runs on circular paths, helical paths and/or spiral paths 11*ab* or in general on essentially rotationally symmetrical paths 11*ab* around the circuit breaker axis 1*a*. The nature of the path can be chosen or influenced by the arrangement of the outlet openings 11, by flow-guiding elements and/or by the shape of the nozzle body 11 and of the baffle wall 14, 140. For example, if the outlet openings 11 are distributed uniformly axially, if the baffle wall 14, 140 is hollow-cylindrical and if the shape of the nozzle body 10 is hollow-cylindrical, predominantly circular paths or helical paths can be induced, while predominantly spiral paths 11*ab* can be induced if the nozzle body 10 has a tapered shape.

Figure 4:
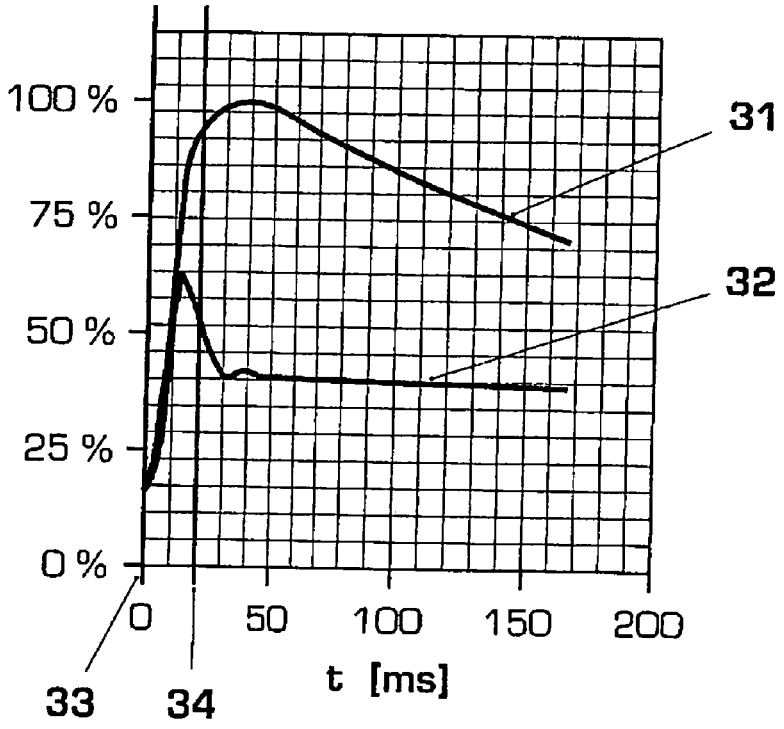
FIG. 4 shows an exemplary exhaust pressure as a function of time.
Figure 5:
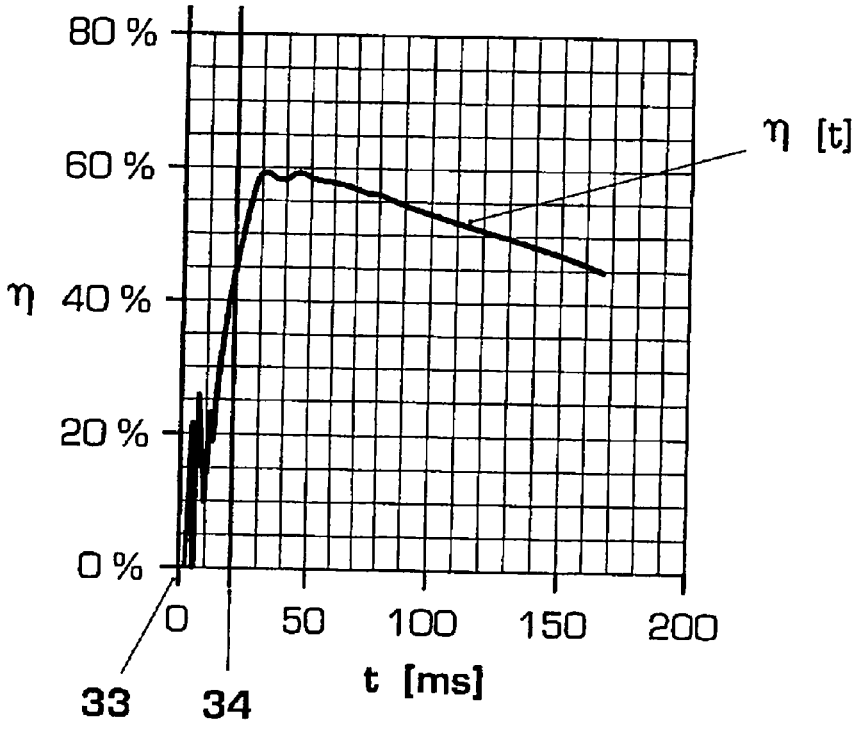
FIG. 5 shows an exemplary cooling efficiency as a function of time.

A theoretical analysis has been carried out for the efficiency $\eta$ of the arrangement with the nozzle body or sleeve 10 and the baffle wall 14, 140. The efficiency or the cooling efficiency $\eta$ of the sleeve 10 is defined as the ratio of the thermal energy extracted from the switching gas with the aid of the sleeve 10 to the total thermal energy of the hot switching gas. It can be shown that, approximately:

$$\eta(t)=(p_2-p_2')/p_2,$$

where $p_2$=switching gas pressure without the sleeve 10 in the first exhaust area 7 after circuit breaker contact separation; and $p_2'$=switching gas pressure in the presence of the sleeve 10 in the first exhaust area 7 averaged over the inner and outer volumes 7*a*, 7*b*, likewise after circuit breaker contact separation. The pressure $p_2$ without the sleeve 10 has been measured experimentally and the pressure $p_2'$ with the sleeve 10 has been determined by measuring a first pressure in the outer volume 7*b* and by calculating a second pressure in the inner volume 7*a* by simulation, and wherein the first and second pressure were weighted with their associated volumes 7*a*, 7*b* and were averaged. FIG. 3 shows the pressure profile 31 as a function of time for an exhaust 7 without a metal sleeve 10, and a pressure profile 32 with a metal sleeve 10. After contact separation 33, the pressure rise with the same gradient is limited to about 50% of the previously usual value. The pressure now already falls again when the current zero crossing 34 is passed, thus overall leading to a considerable pressure reduction throughout the switching process. FIG. 4 shows the cooling efficiency $\eta(t)$, which is more than 45% after the current zero crossing 34, and briefly reaches a maximum of 60%.

Furthermore, experimental trials have been carried out with a circuit breaker 1 with a metal sleeve 10 and a switching enclosure baffle wall 14. The volume-to-area ratio of the metal sleeve 10 was 1.05 m in the trial. This ratio takes account of the fact that, in the present case, approximately 80% of the geometric area A of the outlet openings 11 is actually effective. Currents in the region of more than 63 kA and with a heavy imbalance, long arcing times and an energy input resulting from this of about 1 MJ were disconnected without faults in the circuit breaker 1 in the trials laboratory. It has therefore been verified experimentally and theoretically that the disclosure can make a major improvement to the heat dissipation from the switching gas. In addition, the switching chamber enclosure 3 can be protected against hot gases by the metal sleeve 10.

In further exemplary embodiments, which are not described here, at least one further body with further outlet openings for production of further gas jets is provided in the inner volume 7*a*, and the inner volume 7*a* is subdivided by the further body into an inner and an outer sub-volume, with at least one further baffle wall being arranged in the outer sub-volume such that the further gas jets are directed against the further baffle wall. Advantageously, at least in each case one body 10 and at least in each case one associated baffle wall 14, 140 are provided in a first exhaust area 7 of the first contact 4 and in a second exhaust area 8 of the second contact 5. The switching chamber enclosure 3 may be a pressure-tight encapsulating enclosure 3 for the switching gas, in particular the quenching gas and exhaust gas. The switching chamber enclosure 3 may be surrounded by an outer enclosure, for magnetic field shielding. The outer enclosure can at the same time be in the form of a mechanical holder for the switching device 1. The disclosure is applicable to all types of electrical switching devices 1, in particular generator circuit breakers 1, circuit breakers with a rotating arc, self-blowing circuit breakers, gas or $SF_6$ circuit breakers and circuit breakers with a hollow contact tube for carrying the switching gas away from the arc quenching zone.

A further subject matter of the disclosure is a method for cooling of a switching gas in an electrical switching device 1 for electrical power supply systems, in particular in a generator circuit breaker 1, with the switching device 1 having a switching chamber 2 which is surrounded by a switching chamber enclosure 3, furthermore with the switching gas flowing from an arc quenching zone 6 to an exhaust area 7, 8 during a switching process, in the process passing through a body 10 which has a multiplicity of outlet openings 11, and being split into a plurality of directed gas jets 12, furthermore with the gas jets 12 being swirled into a plurality of vortices 13 and with thermal energy being extracted from the vortices 13 by convection in an area 14*a* of a baffle wall 14, 140, wherein the baffle wall 14, 140 is formed by at least one section 14 of the switching chamber enclosure 3, or is attached to a section of the switching chamber enclosure 3. The following text describes a number of exemplary embodiments.

The baffle wall 14, 140 can be kept at the same potential as the switching chamber enclosure 3. The baffle wall 14, 140 may also be kept at the same temperature as the switching chamber enclosure 3 by thermal conduction. The formation of the switching-gas vortices 13 can be supported by interaction of the gas jets 12 with one another before reaching the baffle wall 14, 140. In particular, the gas jets 12 which are formed in the body 10 are such that their trajectories 121, 122 cross one another before reaching the baffle wall 14, 140. The jet characteristic of the outlet openings 11 can also be matched to the distance H from the baffle wall 14, 140 such that the vortices 13 are formed adjacent to or in the area 14*a* of the baffle wall 14, 140. The switching gas and, in particular, the vortices 13 are advantageously guided on circular paths, helical paths or on spiral paths along the baffle wall 14, 140, about the central axis 1*a* of the switching device 1.

A further subject matter of the disclosure is a section of an electrical high-voltage installation which has an electrical switching device 1, e.g., a generator circuit breaker 1.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Electrical switching device
1*a* Central axis, circuit breaker axis
2 Switching chamber
3 Switching chamber enclosure, switching chamber wall
3*a* First exhaust housing or enclosure
3*b* Second exhaust housing or enclosure
3*c* Interrupting chamber housing, quenching chamber isolator
4 First contact, (arcing) contact pin
5 Second contact, (arcing) contact tulip
6 Arc quenching zone
6*a* Arc
7 First exhaust area
7*a* Inner volume
7*b* Outer volume
7*c* Flow deflection element
8 Second exhaust area
9 Interrupting or quenching chamber
10 Body, nozzle body, sleeve, metal sleeve
100 Switching-gas flow from quenching zone
101 Recirculation flow in inner volume
11 Outlet openings
11*a*, 11*b* Radially opposite areas
11*ab* Circular paths, helical paths, spiral paths
110, 111, 112 Nozzle shapes
12 Gas jets
12*a* Separation area
12*b* Vortex-formation area
121, 122 Trajectories
13 Vortices
130 Vortex area, area of convective turbulent heat transfer, vortex boundary layer
131 Outlet area
132 Wake area, suction area
14 Baffle wall, interrupting chamber enclosure section
140 Baffle wall, plate, heat sink
14*a* Baffle wall area
15 Current path
16 First stationary rated-current contact
17 Second stationary rated-current contact
18 Moving rated-current contact
19 First barrier wall
20 Arcing contact arrangement
21 Dielectric nozzle
22 Sliding guide
23 Second barrier wall
24 Heating volume
25 Blowing slot
26 Wall
27 Blowing cylinder
28 Blowing piston
29 Blowing channel
30 Non-return valve
31 Pressure profile (prior art)
32 Pressure profile with body and baffle wall
33 Contact separation
34 Current zero crossing
D Diameter of outlet openings
H Distance between outlet opening and baffle wall
S Mean distance between outlet openings
t Time
η Efficiency

What is claimed is:

1. An electrical switching device for an electrical power supply system, comprising:

a switching chamber which is surrounded by a switching chamber enclosure and has a central axis, a first contact, a second contact, and a body with outlet openings for switching gas to flow through being provided in an exhaust area of the first or second contact, with the exhaust area being subdivided by the body into an inner volume and an outer volume, and a baffle wall for cooling the switching gas being provided in the outer volume, wherein the outlet openings of the body are configured to produce a plurality of directed gas jets directed towards the baffle wall, and are configured to produce a plurality of vortices for providing a convective heat transfer from the switching gas to the baffle wall, wherein a) the baffle wall is attached as a heat sink to a section of the switching chamber enclosure, and b) the baffle wall is thermally conductively connected to the switching chamber enclosure, wherein the outlet openings of the body are nozzles which predetermine a desired jet characteristic and/or alignment for the gas jets by virtue of their arrangement, shape and/or alignment, and wherein:

c) the nozzles are tapered in the form of a funnel in the radial flow direction of the switching gas, and/or d) nozzles are provided, which are directed with respect to one another such that the trajectories of the associated gas jets will cross one another before reaching the baffle wall and form vortices before reaching the baffle wall.

2. The electrical switching device as claimed in claim 1, wherein a) the baffle wall is at the same electrical potential as the switching chamber enclosure, and/or b) the baffle wall is part of a current path of the switching device.

3. The electrical switching device as claimed in claim 1, wherein the body has a low thermal capacity and/or a low thermal conductivity.

4. The electrical switching device as claimed in claim 1, wherein a) the body is a sleeve whose enclosed volume V relative to the total area A of the outlet openings forms a ratio which is in the range 0.5 m<V/A<1.5 m, and/or b) the outlet openings on the body are arranged more frequently in two radially opposite areas in order to induce a flow in the switching gas in the outer volume, which flow is guided on circular paths, helical paths, and/or spiral paths along the baffle wall.

5. The electrical switching device as claimed in claim 1, wherein at least in each case one associated body and at least in each case one associated baffle wall are provided in a first exhaust area of the first contact and in a second exhaust area of the second contact.

6. The electrical switching device as claimed in claim 4, wherein the ratio is in the range of 1 m<V/A<1.4 m.

7. The electrical switching device as claimed in claim 4, wherein the ratio is in the range of 1.2 m<V/A<1.3 m.

8. The electrical switching device as claimed in claim 1, wherein a) the switching chamber enclosure is a pressure-tight encapsulating enclosure for the switching gas, and/or b) the switching chamber enclosure is surrounded by an outer enclosure, which shields magnetic fields, and/or c) the switching device is a generator circuit breaker.

9. An electrical switching device for an electrical power supply system, comprising:

a switching chamber which is surrounded by a switching chamber enclosure and has a central axis, a first contact, a second contact, and a body with outlet openings for switching gas to flow through being provided in an exhaust area of the first or second contact, with the exhaust area being subdivided by the body into an inner volume and an outer volume, and a baffle wall for cooling the switching gas being provided in the outer volume, wherein the outlet openings of the body are configured to produce a plurality of directed gas jets directed towards the baffle wall, and are configured to produce a plurality of vortices for providing a convective heat transfer from the switching gas to the baffle wall, wherein:

a) the baffle wall is attached as a heat sink to a section of the switching chamber enclosure, and b) the baffle wall is thermally conductively connected to the switching chamber enclosure, and wherein:

c) at least one further body with further outlet openings for producing further gas jets is or are provided in the inner volume, and the inner volume is subdivided by the further body into an inner and an outer volume element, and d) at least one further baffle wall is arranged in the outer volume element such that the further gas jets are directed against the further baffle wall.

10. The electrical switching device as claimed in claim 9, wherein a) the switching chamber enclosure is a pressure-tight encapsulating enclosure for the switching gas, and/or b) the switching chamber enclosure is surrounded by an outer enclosure, which shields magnetic fields, and/or c) the switching device is a generator circuit breaker.

11. The electrical switching device as claimed in claim 9, wherein at least in each case one associated body and at least in each case one associated baffle wall are provided in a first exhaust area of the first contact and in a second exhaust area of the second contact.

12. A method for cooling of a switching gas, in an electrical switching device for electrical power supply systems, with the switching device having a switching chamber which is surrounded by a switching chamber enclosure, wherein during a switching process the switching gas flows from an arc quenching zone to an exhaust area, thereby passes through a body which has a multiplicity of outlet openings, and is split into a plurality of directed gas jets, wherein the gas jets are swirled into a plurality of vortices and thermal energy is extracted from the vortices by a baffle wall through convection in the area of the baffle wall, wherein:

a) the baffle wall is formed by at least one section of the switching chamber enclosure, or is directly attached to a section of the switching chamber enclosure, and b) the thermal energy is passed to the switching chamber enclosure which is thermally connected to the baffle wall, and wherein:

c) the formation of the vortices is supported by interaction of the gas jets with one another before reaching the baffle wall, and d) the gas jets which are formed in the body are such that their trajectories cross one another before reaching the baffle wall.

13. The method for cooling of a switching gas as claimed in claim 12, wherein a) the baffle wall is held at the same electrical potential as the switching chamber enclosure, and/or b) the baffle wall is kept at the same temperature as the switching chamber enclosure by thermal conduction.

14. The method for cooling of a switching gas as claimed in claim 12, wherein the switching gas is guided on circular paths, helical paths or on spiral paths along the baffle wall.

15. The method for cooling of a switching gas as claimed in claim 12, wherein a hot switching gas flows from the arcing zone into the exhaust area, is deflected by a flow deflection element into a radial direction, flows back along an inner wall of the body, and thus a recirculation flow being formed, by which a backpressure is built up in the inner volume of the body.

16. The method for cooling of a switching gas as claimed in claim 12, wherein a vortex boundary layer is formed in the baffle wall area, in which the vortex passes along the baffle wall, deposits a portion of its thermal energy there, flows away from the baffle wall in an outlet area of the vortex, is recirculated, and sucks in further switching gas in a wake area and supplies it to the baffle wall for being cooled.

17. The method for cooling of a switching gas as claimed in claim 12, wherein the switching gas is guided on circular paths, helical paths or on spiral paths along the baffle wall.

18. The method for cooling of a switching gas as claimed in claim 14, wherein a hot switching gas flows from the arcing zone into the exhaust area, is deflected by a flow deflection element into a radial direction, flows back along an inner wall of the body, and thus a recirculation flow being formed, by which a backpressure is built up in the inner volume of the body.

19. The method for cooling of a switching gas as claimed in claim 15, wherein a vortex boundary layer is formed in the baffle wall area, in which the vortex passes along the baffle wall, deposits a portion of its thermal energy there, flows away from the baffle wall in an outlet area of the vortex, is recirculated, and sucks in further switching gas in a wake area and supplies it to the baffle wall for being cooled.

20. The method for cooling of a switching gas as claimed in claim 12, wherein a jet characteristic of the outlet openings is matched to a distance (H) to the baffle wall such that the vortices are formed adjacent to or in the area of the baffle wall.

* * * * *